US011944867B2

(12) United States Patent
Karpachevskyy et al.

(10) Patent No.: US 11,944,867 B2
(45) Date of Patent: Apr. 2, 2024

(54) PORTABLE ANGLE- AND DEPTH-ADJUSTABLE HANGBOARD

(71) Applicants: Taras Karpachevskyy, Calgary (CA); Li Yu Yang, Calgary (CA)

(72) Inventors: Taras Karpachevskyy, Calgary (CA); Li Yu Yang, Calgary (CA)

( * ) Notice: Subject to any disclaimer, the term of this patent is extended or adjusted under 35 U.S.C. 154(b) by 0 days.

(21) Appl. No.: 17/500,941

(22) Filed: Oct. 14, 2021

(65) Prior Publication Data

US 2023/0124753 A1 Apr. 20, 2023

(51) Int. Cl.
*A63B 23/16* (2006.01)

(52) U.S. Cl.
CPC ..... *A63B 23/16* (2013.01)

(58) Field of Classification Search
CPC ..... A63B 23/16; A63B 23/1218
See application file for complete search history.

(56) References Cited

U.S. PATENT DOCUMENTS 9,468,805 B2 10/2016 White
10,252,099 B2 4/2019 Karpachevskyy
2011/0319230 A1* 12/2011 Brendle ..... A63B 21/4013 482/37
2013/0184124 A1* 7/2013 Reed ..... A63B 21/1627 482/37
2014/0221163 A1* 8/2014 Mcbride ..... A63B 21/00047 482/40
2018/0126218 A1* 5/2018 Curry ..... A63B 21/0552
2019/0247714 A1* 8/2019 Curry ..... A63B 21/068
2021/0106895 A1* 4/2021 Gopalakrishnan ..... A63B 23/12
2021/0291029 A1* 9/2021 Poulin ..... A63B 23/16
2022/0126168 A1* 4/2022 Riveros Salazar .. A63B 21/068

FOREIGN PATENT DOCUMENTS

WO WO-2023274738 A1 * 1/2023

* cited by examiner

*Primary Examiner* — Joshua T Kennedy

(57) ABSTRACT

A new kind of portable hangboard intended for finger strength exercises allows the user to adjust the angle of the hangboard and the depth of the finger slot to control the difficulty of the exercise. The main body of the hangboard hangs on a rope. The main body of the hangboard contains multiple slots that the rope can pass through to adjust the angle of the device. The finger slot contained in the main body has magnets at the deep end which allow one or more shims with built in magnets to be inserted to make the slot shallower. The hangboard offers greater portability and variety of exercises compared to other inventions of this class.

3 Claims, 12 Drawing Sheets

PORTABLE ANGLE- AND DEPTH-ADJUSTABLE HANGBOARD

FIELD

This application relates to exercise apparatus to build finger and grip strength. Likely classifications are 482/126, 482/123, 482/121

BACKGROUND

Many sport and life activities require a strong grip or finger strength. Especially with sports like climbing, obstacle racing, weight training, and martial arts. Studies have shown that increase in finger strength will improve overall performance in all types of sports. Increased finger strength decreases the chances for injuries like tennis elbow and carpal tunnel syndrome.

Hangboards are one of the most popular training tools to increase finger strength. They consist of a wooden or plastic board that incorporates multiple pockets and ledges of different shapes and depths that the user can hang from. As a result, they are large, have to be screwed into a wall, and are not easily transportable. They also do not allow the user to change the pull force easily—they use the full body weight of the person as the pull force. Despite these limitations, hangboards remain one of the most common ways to train grip strength, especially for climbers. Their primary advantage is that a hangboard can incorporate several different finger pocket shapes, allowing for different finger exercises.

Portable hangboards exist (ex U.S. Pat. No. 9,468,805B2), but are restricted in terms of what exercises they allow the user to do due to limited space. Portable hangboards with interchangeable grips also exist (ex US20190247714A1), but they require the user to carry all the grips that they want separately, and as a result the number of different grips/exercises is limited. Existing designs lend themselves well to a few specific exercises (such as crimps on a small ledge), but the exercise cannot be easily made slightly more difficult or slightly harder—swapping to a different attachment changes the exercise completely. They also somewhat complex with small moving parts, which can lead to reduced durability and increased cost.

There are also inventions for mounting a full size hangboard in a non-permanent way (ex US20130184124A1), which can be used at home, but they are as large and heavy as a full size hangboard.

SUMMARY

The Portable angle- and depth-adjustable hangboard of the present invention allows for a similar or greater variety of finger strengthening exercises as a traditional hangboard, while being small and compact, and without requiring the user to carry separate attachments for different exercises. It does this by incorporating simple and robust angle and depth adjustment mechanisms into an apparatus the size of a handle. This means that the user can, in a combination not offered by the prior art, carry the hangboard with them, adjust it to the depth and angle they want, and exercise either by securing the hangboard to an appropriate anchor point and hanging from it, or by attaching it to a resistance machine, resistance band, bungee cord, or weight and pulling with the desired amount of force.

The Portable angle- and depth-adjustable hangboard can be used at home by using a portable opposably mounted pull up device (ex U.S. Ser. No. 10/252,099B2) to non-permanently secure it to a door frame during an exercise session. This combination offers a similar or greater variety of exercises as a permanently mounted full size hangboard, while being easy to carry around and mount at home, in a hotel, at work, or any other location that has a suitable door frame.

In the present invention, any combination of angle and depth is possible. This results in a large number of possible exercise difficulties depending on the angle and depth chosen. The combination of the two adjustments can accommodate users of all different skill levels from beginner to expert.

BRIEF DESCRIPTION OF DRAWINGS

The accompanying drawings which are incorporated in and form a part of the specification illustrate preferred embodiments of the present invention and, together with a description, serve to explain the principles of the invention. The drawings are not to be considered limiting of the scope of the invention. The drawings are not necessarily to scale and in some instances proportions may have been exaggerated in order to more clearly depict certain features. In the drawings.

DESCRIPTION OF EMBODIMENTS

Figure 1:
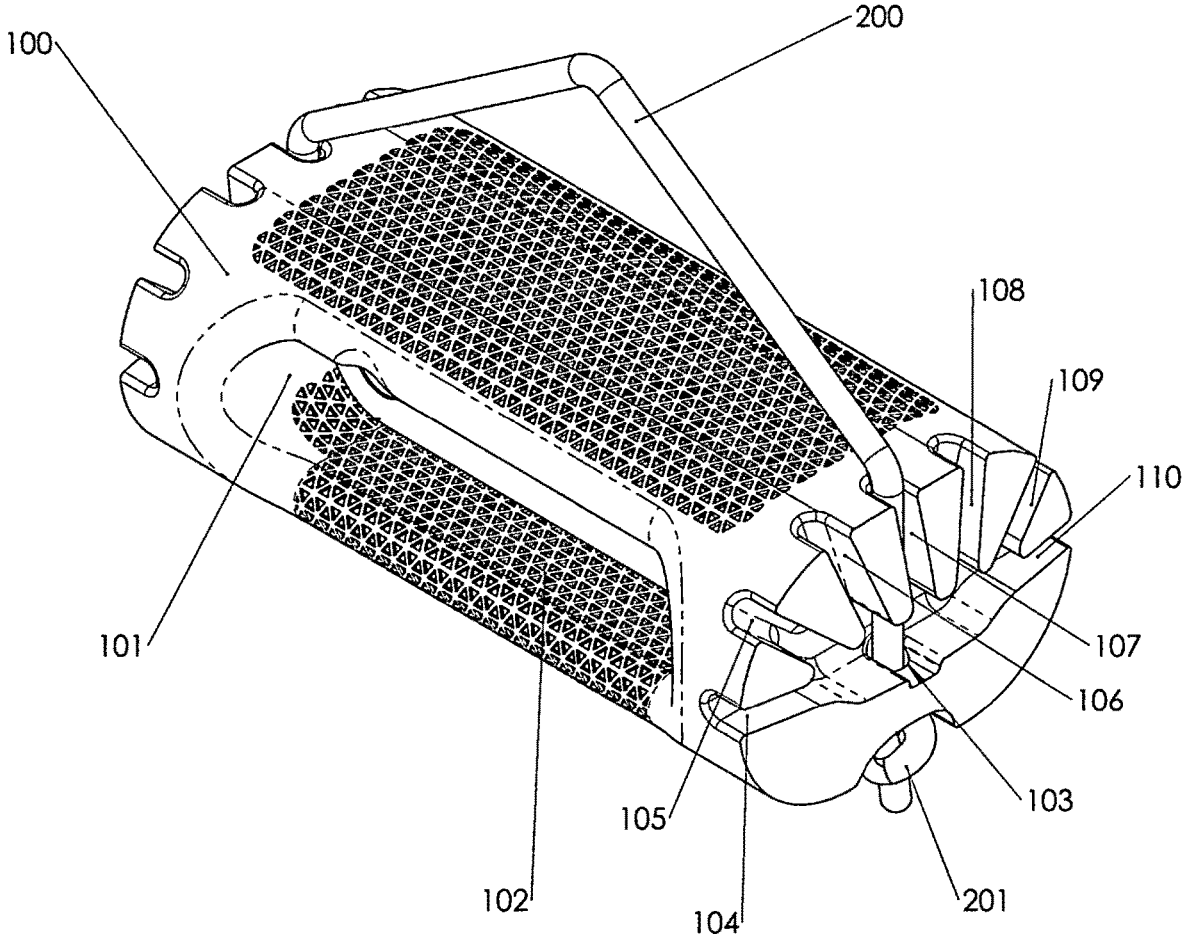
FIG. 1 is an isometric view showing an embodiment of the portable angle- and depth-adjustable hangboard, while highlighting the main functional features of the invention.

The description that follows and the embodiments described therein are intended to clarify the nature and principles of the invention by means of examples. These examples are provided for the purposes of explanation, and not of limitation, of those principles and of the invention. In the description, similar parts are marked throughout the specification and the drawings with the same respective reference numerals.

Figure 2:
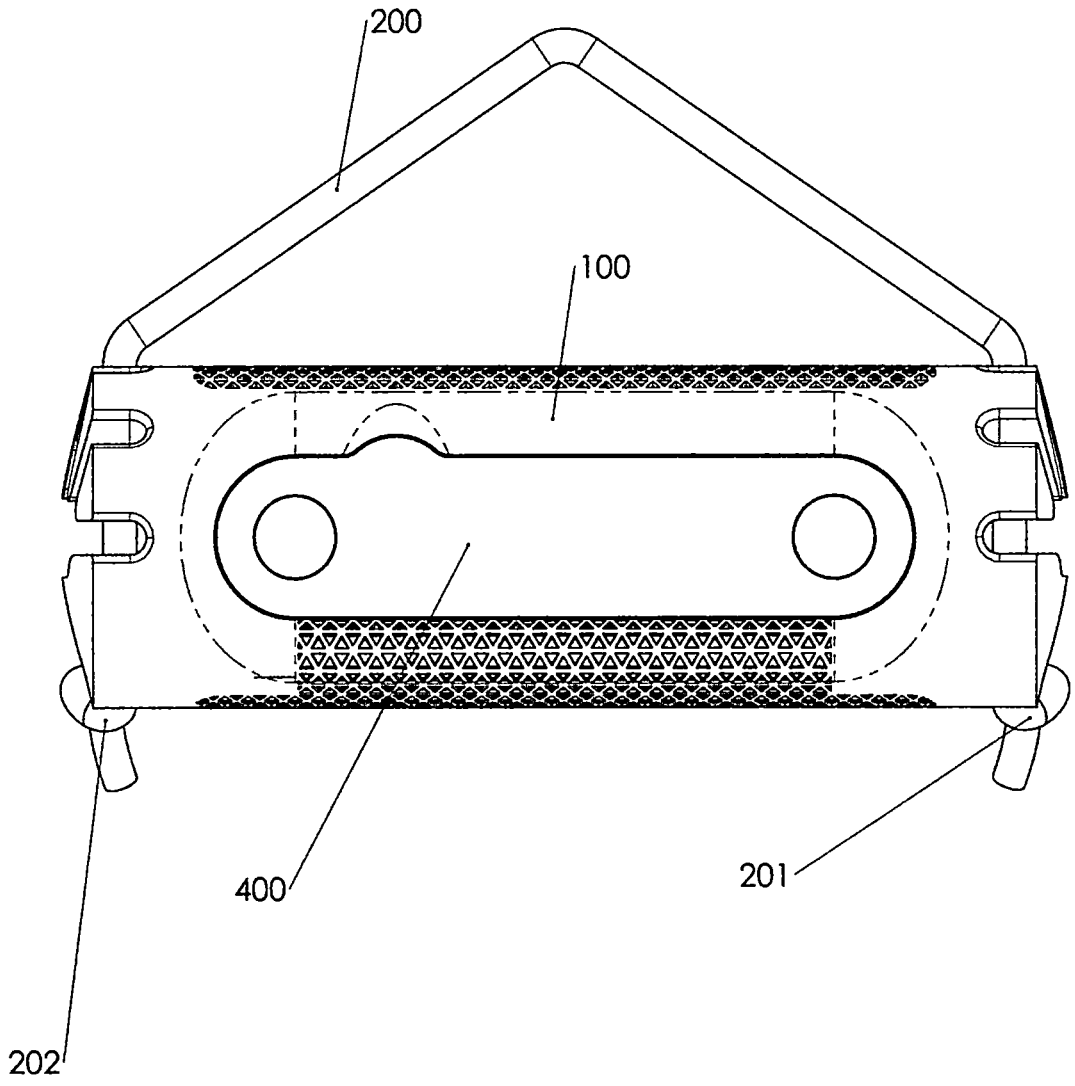
FIG. 2 is a front view showing the same embodiment as FIG. 1.
Figure 3:
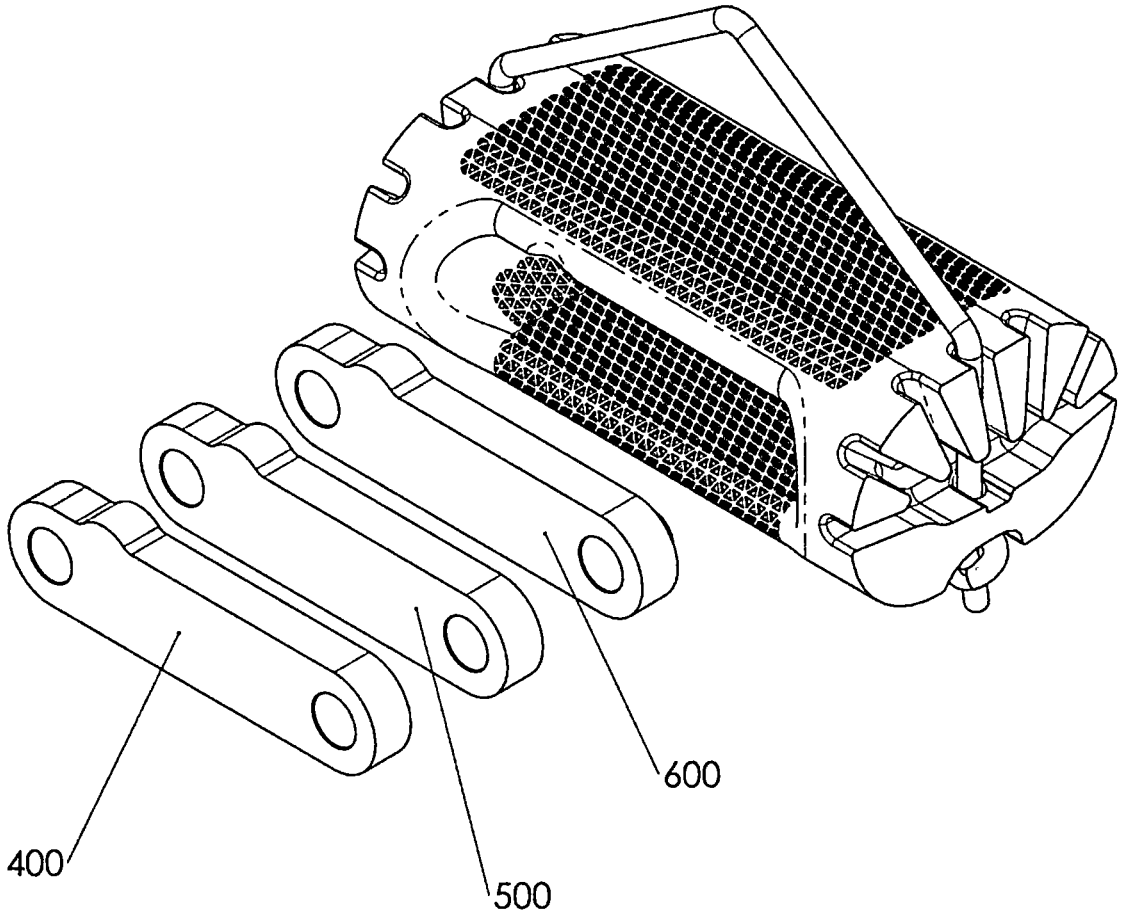
FIG. 3 is an isometric view of the same embodiment as FIG. 1 with the shims taken out of the slot.
Figure 4:
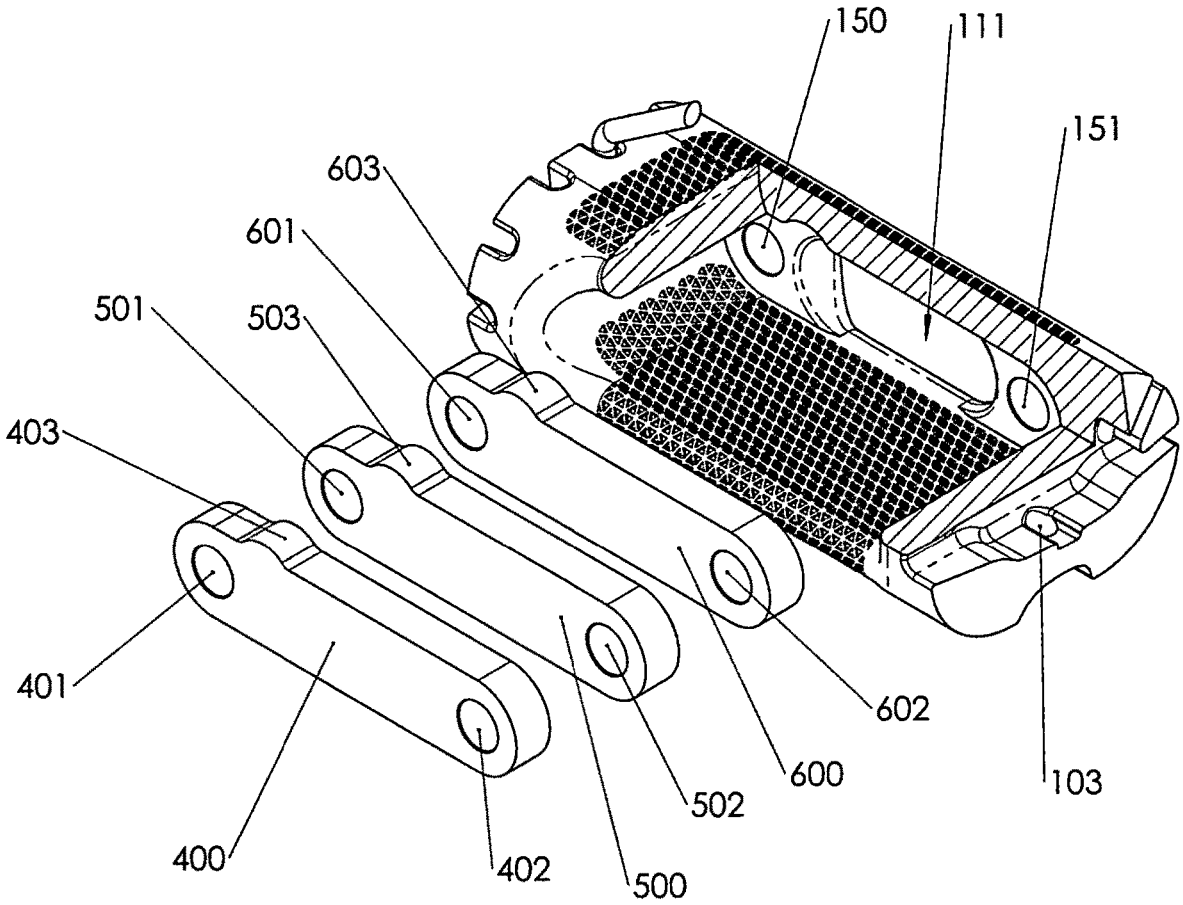
FIG. 4 is an exploded and cutaway isometric view of the same embodiment as FIG. 1 which highlights the details of the finger slot, the shims used for depth adjustment and the magnets which hold the shim in place.
Figure 5:
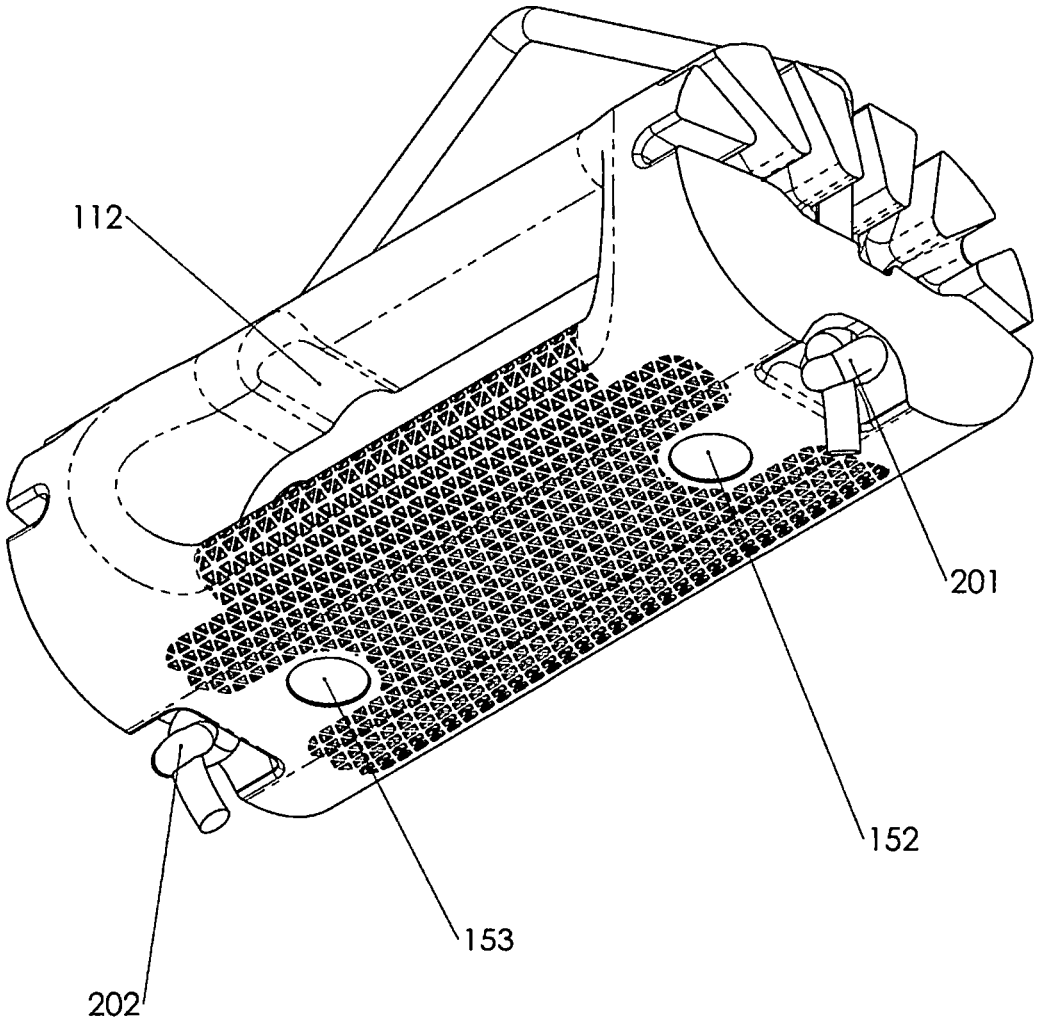
FIG. 5 is an isometric view from the bottom of the same embodiment as FIG. 1.
Figure 6:
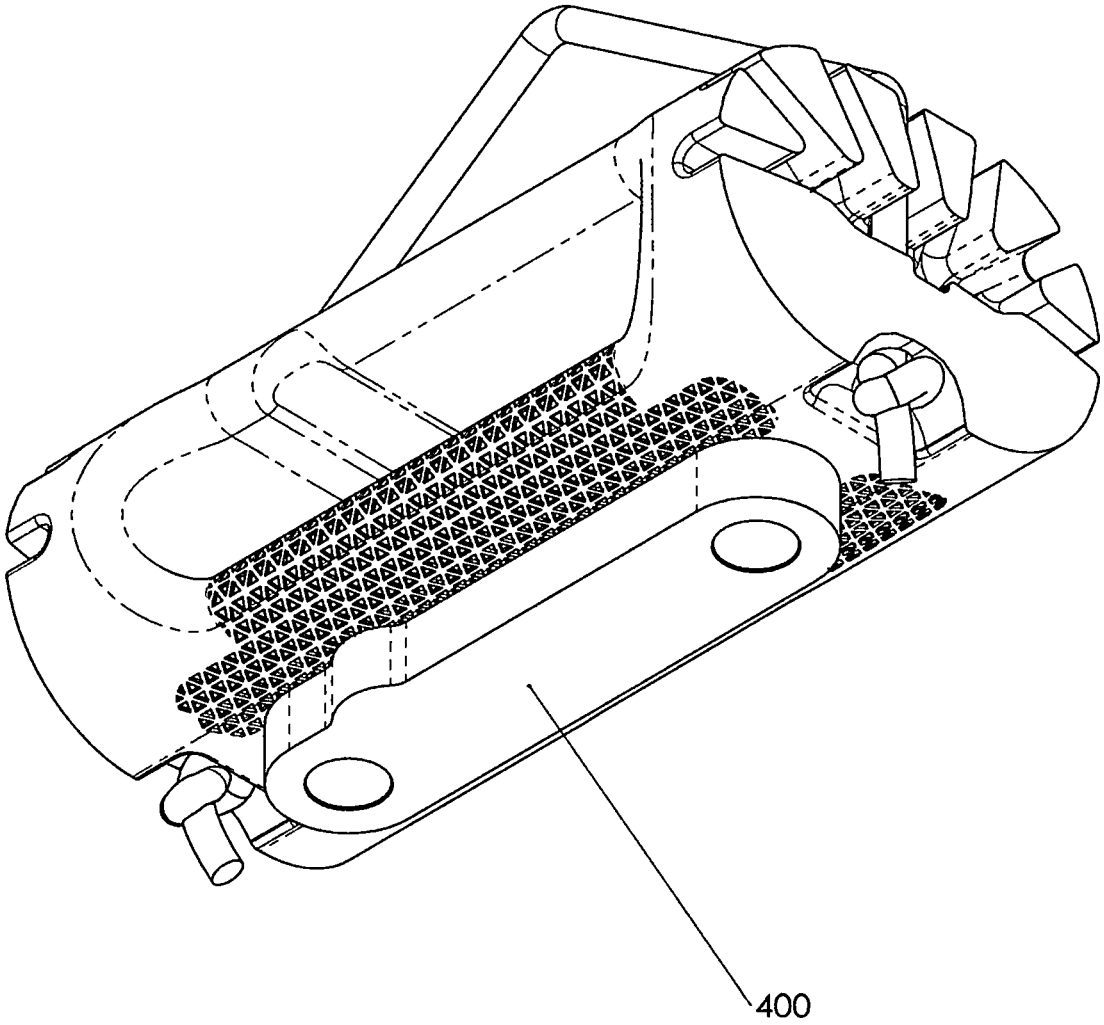
FIG. 6 is an isometric view from the bottom of the same embodiment as FIG. 1, which shows how shims can be stored at the bottom when not in use inside the slot.

Referring to FIGS. 1 to 6, shown—from different angles and in different configurations—is one possible fully assembled embodiment of the present invention, highlighting its essential constituents and the features through which it interacts with external elements. The embodiment shown consists of a main body 100, rope 200, and shims 400, 500, and 600. The main body 100 features a finger slot 101 which has a slot bottom surface 102 that the user can grip with their fingers during usage. The depth of slot 101 can be adjusted by inserting or removing shims 400, 500, and 600 into slot 101. The exercise difficulty increases by making the slot shallower by adding more shims, and it decreases by making the slot deeper by taking out shims.

Figure 7:
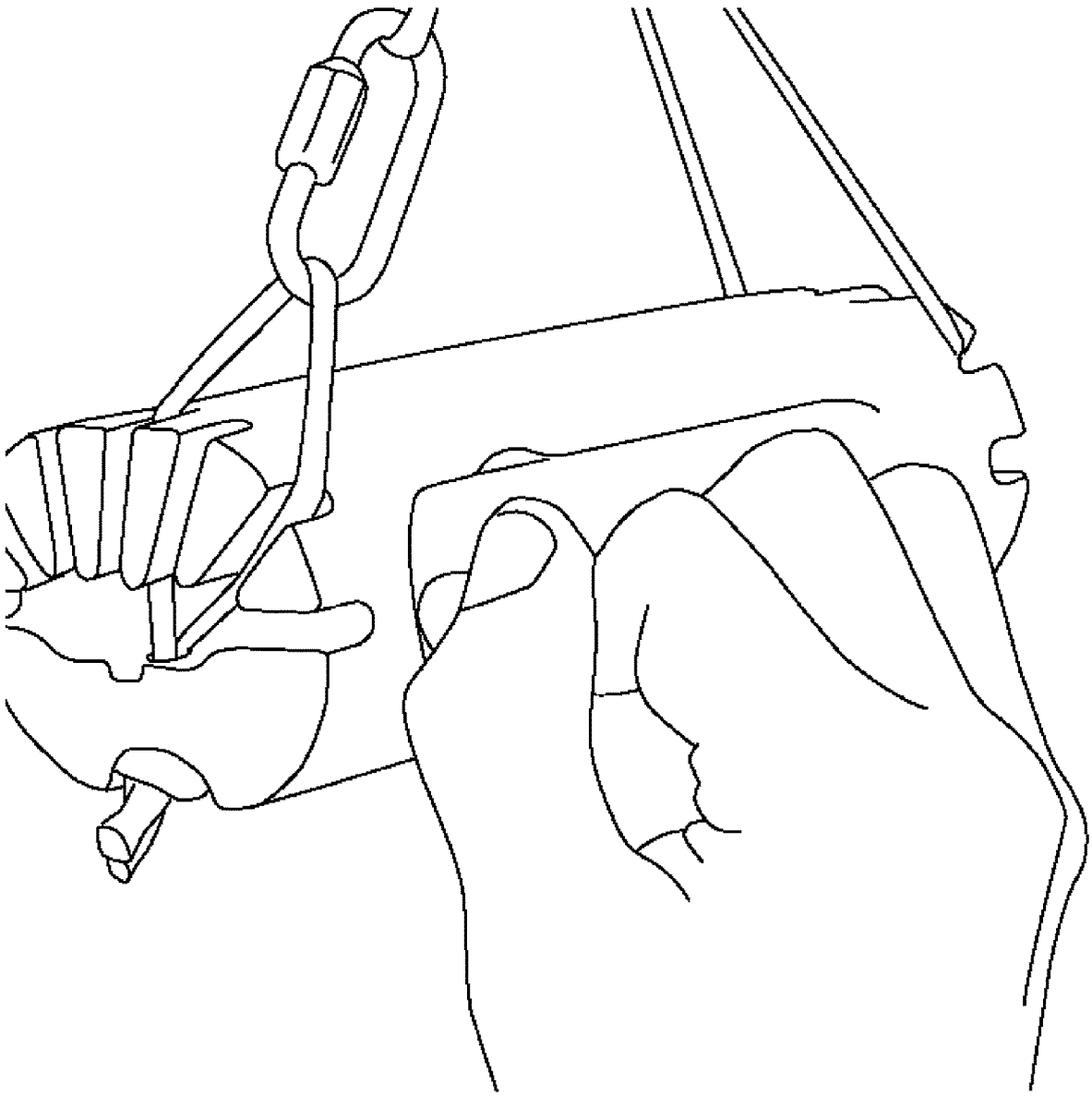
FIG. 7 shows a user holding the portable angle- and depth-adjustable hangboard in a 'crimp' hold.
Figure 8:
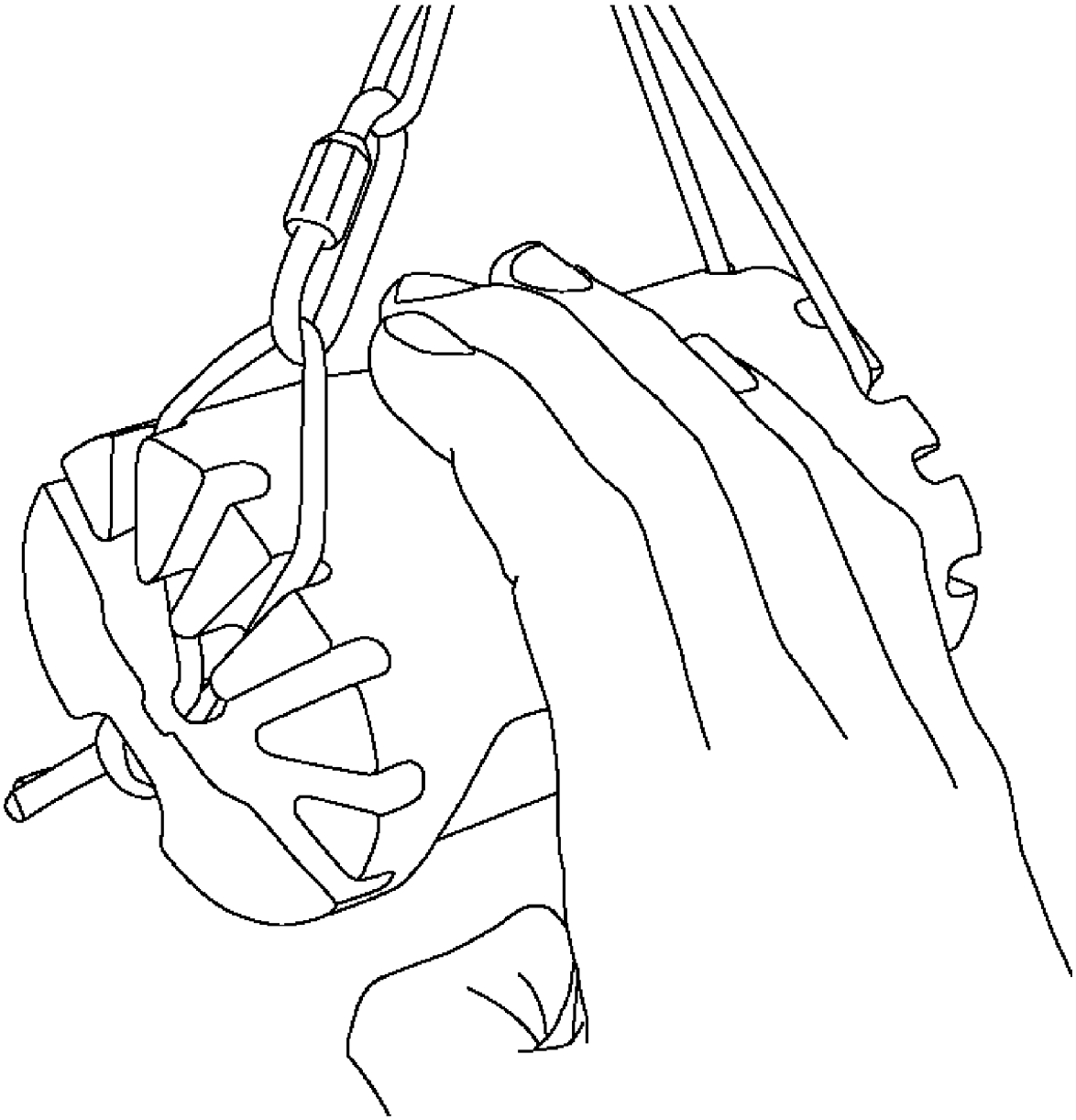
FIG. 8 shows a user holding the portable angle and depth adjustable hangboard in a 'sloper' hold.
Figure 9:
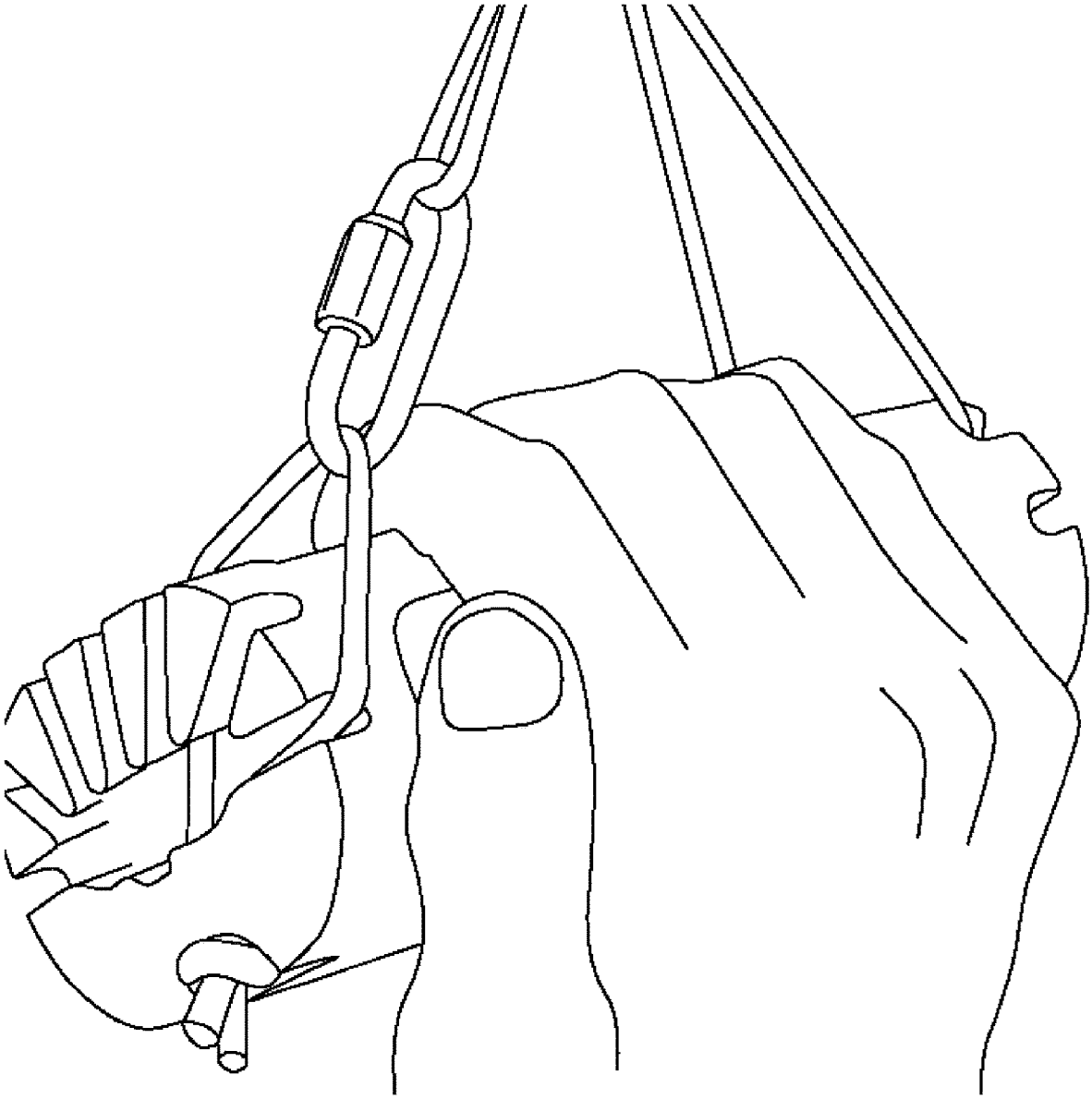
FIG. 9 shows a user holding the portable angle and depth adjustable hangboard in a reverse 'sloper' hold.
Figure 10:
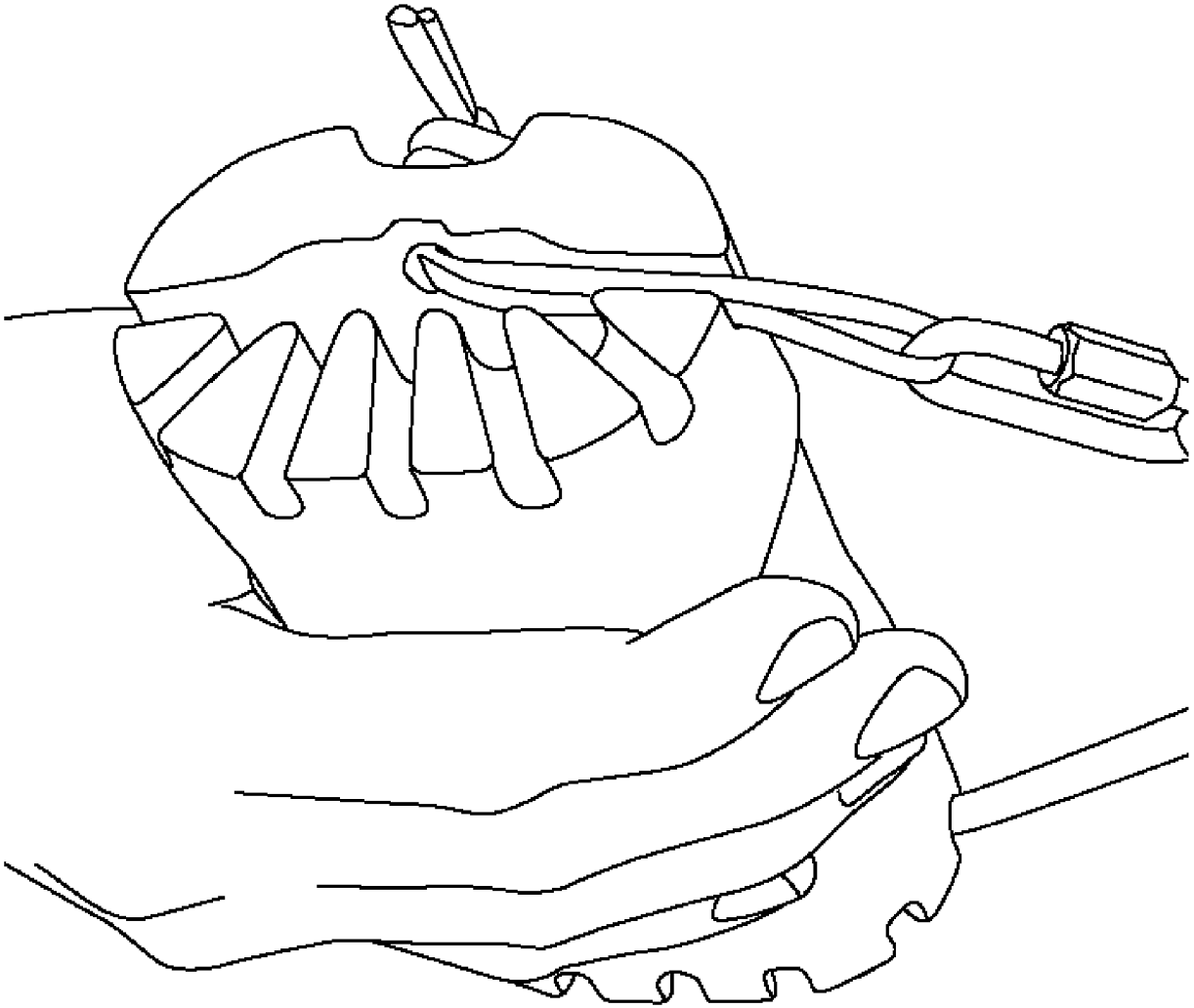
FIG. 10 shows a user holding the portable angle and depth adjustable hangboard in a vertical 'pinch' hold.
Figure 11:
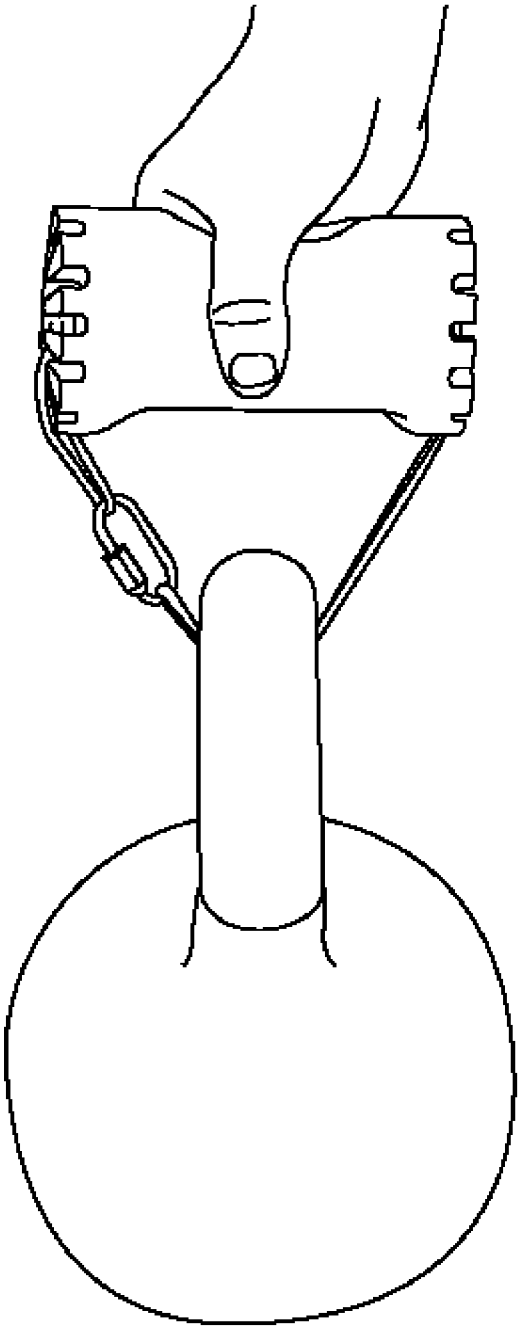
FIG. 11 shows the portable angle and depth adjustable hangboard attached to a weight.
Figure 12:
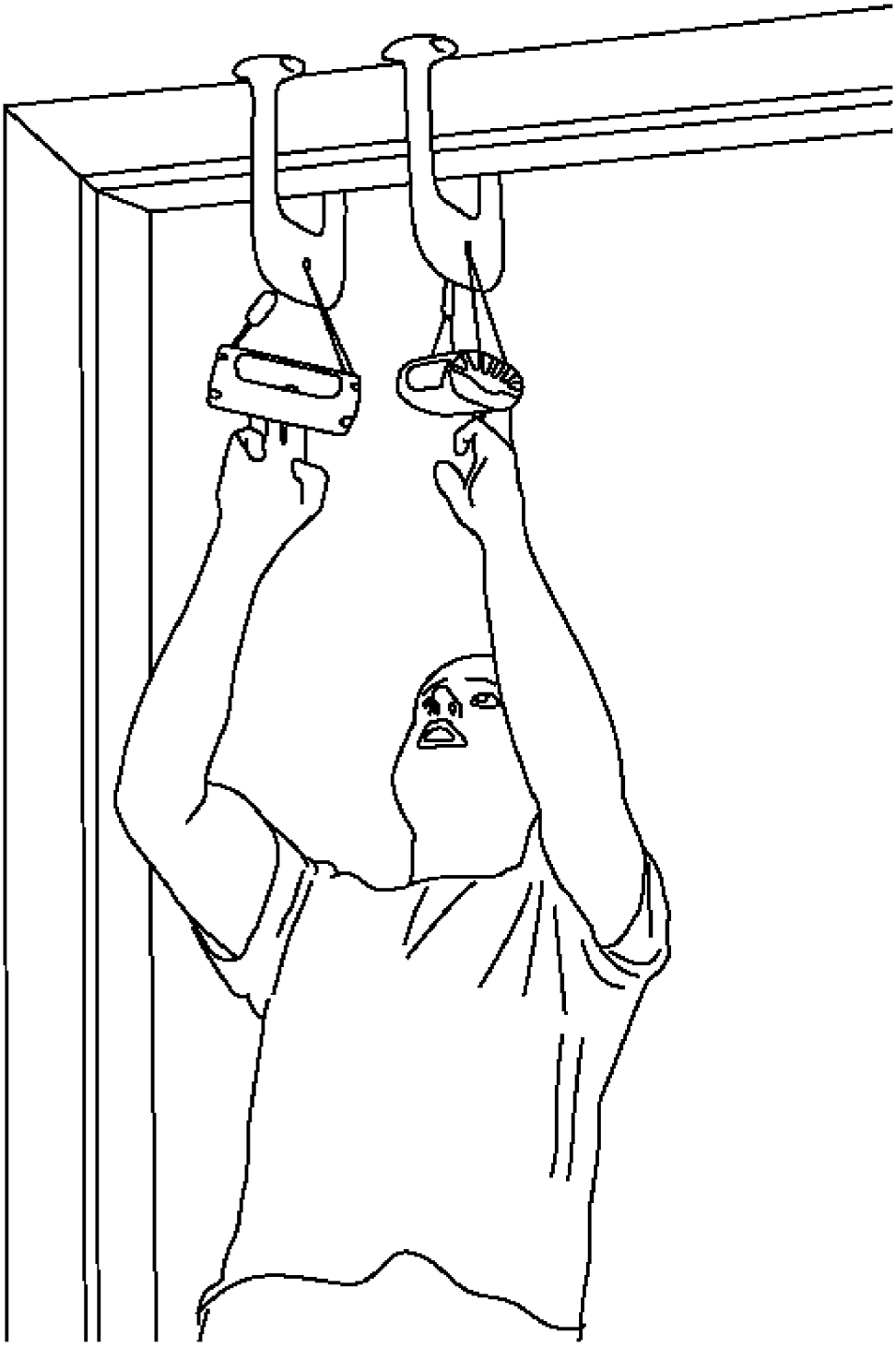
FIG. 12 shows a person using the portable angle- and depth-adjustable hangboard attached to a portable opposably mounted pull up device hanging on a door frame.

The main body 100 contains hole 103 to which rope 200 is attached with knot 201. The opposite end of rope 200 is attached the same way with knot 202. Rope 200 is used to anchor the main body either to a fixture, such as a fixed hook or anchor, or to a weight or similar during exercise. Examples of anchoring are shown in FIGS. 7-13. Also in the main body 100 above hole 103, there are grooves 104, 105, 106, 107, 108, 109, and 110 that rope 200 can be passed through. There are similar grooves for rope 200 on the opposite side of the main body. These grooves form the angle adjustment mechanism of the present invention. Depending on which grooves rope 200 passes through, main body 100 along with slot 101 and slot bottom surface 102 will hang at a different angle, which changes the difficulty of the exercise.

Magnets 150 and 151 are permanently glued to main body 100 inside slot 101. They are oriented in such a way as to attract matching magnets 401, 402, 501, 502, 601, and 602 on shims 400, 500, and 600. This attractive force keeps shims 400, 500, and 600 secured inside slot 101 and prevents them from falling out. Hole 111 at the back of main body 100 allows the user to remove shims 400, 500, and 600 from slot 101 by pushing them out with their finger.

Shims 400, 500, and 600 have protrusions 403, 503, and 603 which match up with divet 112 in the top surface of slot 101. This allows the shims to only be inserted one way into slot 101, which ensures that the magnets attract and do not repel each other.

Magnets 152 and 153 are permanently glued to the bottom of main body 100. They provide a storage space for one or more of the shims 400, 500, and 600 at the bottom of main body 100. The user can attach the shims there if they need to be removed from slot 101 to make the slot deeper.

Surfaces which are intended to be gripped by the user are made with a grippy triangular texture, or simply roughness similar to a sandpaper.

The portable hangboard main body 100 can be made by casting a suitable resin (such as polyester or polyurethane) into a mold. The mold is made of 2 pieces which allow the part to be extracted and several pins which form the holes for the rope. The shims can be made the same way. The magnets can be attached using glue.

It is understood that the invention may be embodied in ways different from the one described heretofore, and that other embodiments may be developed without departing from the scope of the appended claims. It is furthermore understood that terms possessing a certain degree of specificity, such as 'doorway frame', are used for exemplification purposes, and that they encompass concepts of a broader nature where appropriate, such as 'supporting structure' in this instance.

For example, the rope configuration of the embodiment shown in FIGS. 1-6 is slightly different from that shown in FIGS. 7-12, but both are within the scope of the present invention.

We claim:

1. A portable finger exercise device comprising:

one or more ropes;

one or more removable shims; and a main body comprising:

a first end and a second end;

attachment points for the one or more ropes at the first end and second end;

two angle adjustment mechanisms at the first and second ends, each of which comprises a plurality of channels that the one or more ropes can be passed through; and a pocket with a surface for a user's fingers between the first end and the second end;

wherein the one or more removable shims fit into the pocket to reduce an effective depth of the pocket.

2. The device of claim 1, wherein both the main body and the one or more removable shims each incorporate one or more magnets, which exert an attractive force between them when the one or more removable shims is inserted fully into the pocket.

3. The device of claim 2, wherein the main body and the one or more removable shims have a shape such that the one or more removable shims can only be inserted one way to ensure the magnetic force is attractive and not repulsive.

* * * * *